US008690803B2

(12) United States Patent
Fullenkamp

(10) Patent No.: US 8,690,803 B2
(45) Date of Patent: Apr. 8, 2014

(54) WALKING MACHINE

(76) Inventor: Ralph Fullenkamp, Fort Recovery, OH (US)

( * ) Notice: Subject to any disclaimer, the term of this patent is extended or adjusted under 35 U.S.C. 154(b) by 590 days.

(21) Appl. No.: 12/983,430

(22) Filed: Jan. 3, 2011

(65) Prior Publication Data

US 2011/0166487 A1 Jul. 7, 2011

Related U.S. Application Data

(60) Provisional application No. 61/291,929, filed on Jan. 4, 2010.

(51) Int. Cl.
*A61H 1/02* (2006.01)

(52) U.S. Cl.
USPC ..... 601/35; 601/5; 601/33; 482/51

(58) Field of Classification Search
USPC ..... 601/5, 23, 24, 26, 27, 29, 34, 33, 35, 601/36; 482/51, 52, 57, 61, 69, 70, 79
See application file for complete search history.

(56) References Cited

U.S. PATENT DOCUMENTS

| | | | | |
|---|---|---|---|---|
| 3,824,994 | A | 7/1974 | Soderberg, Sr. | |
| 5,419,752 | A * | 5/1995 | James et al. | 601/5 |
| 5,941,800 | A | 8/1999 | Laconis | |
| 6,220,991 | B1 * | 4/2001 | Sellers | 601/36 |
| 6,685,658 | B1 | 2/2004 | Dietz et al. | |
| 7,137,959 | B2 | 11/2006 | Phillips | |

* cited by examiner

*Primary Examiner* — Quang D Thanh
(74) *Attorney, Agent, or Firm* — Buckingham, Doolittle & Burroughs, LLC

(57) ABSTRACT

An architecture is presented that provides an exercise device for rehabilitation. The exercise device comprises at least two handles for securing hands of a user; a front rest and a back rest to position a body of the user; and at least two foot pedals for securing feet of the user. A reduction electric motor is used to power the exercise device. Additionally, the exercise device is fitted with wheels to allow the device to be moved. Typically, a user is lifted to a standing position and positioned between the back rest and front rest and secured. The user's hands are then secured to the handles via gloves and the user's feet are secured to the foot pedals via straps. The device is then powered on to exercise muscles of the user.

15 Claims, 4 Drawing Sheets

WALKING MACHINE

CROSS-REFERENCE

This application claims priority from Provisional Patent Application Ser. No. 61/291,929 filed Jan. 4, 2010.

BACKGROUND

After a stroke or spinal injury individuals may be left without the ability to walk. However, it is important to keep paralyzed individuals mobile so that they do not experience muscle atrophy. Teaching a paralyzed individual to walk again can be a daunting task. For example, it is difficult for others to support an individual in a way that allows the individual's muscles to function properly. Furthermore, the rehabilitation process can be long and hard and require a large number of people.

Consequently, a method to facilitate the rehabilitation process is needed. The proposed invention allows a paralyzed individual to stand and move their arms and legs in a walking pattern without the assistance of others. This motion exercises the muscles to aid in rehabilitation and to prevent muscle atrophy.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an exercise device for rehabilitation. The exercise device comprises at least two handles for securing hands of a user; a front rest and at least one back rest to position a body of the user; and at least two foot pedals for securing feet of the user. A reduction electric motor is used to power the exercise device. Additionally, the exercise device is fitted with wheels to allow the device to be moved.

Furthermore in a preferred embodiment of the present invention, the exercise device comprises two units joined together to secure the user in place between the two units. The first unit comprises the at least one back rest, at least two sets of braces that are raised and secured on either side of the user and an electric motor. The second unit comprises the front rest, at least two handles and at least two foot pedals. A user is lifted to a standing position and positioned between the at least one back rest and the front rest and secured. The user's hands are then secured to the handles via gloves and the user's feet are secured to the foot pedals via straps. The device is then powered on to exercise muscles of the user.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
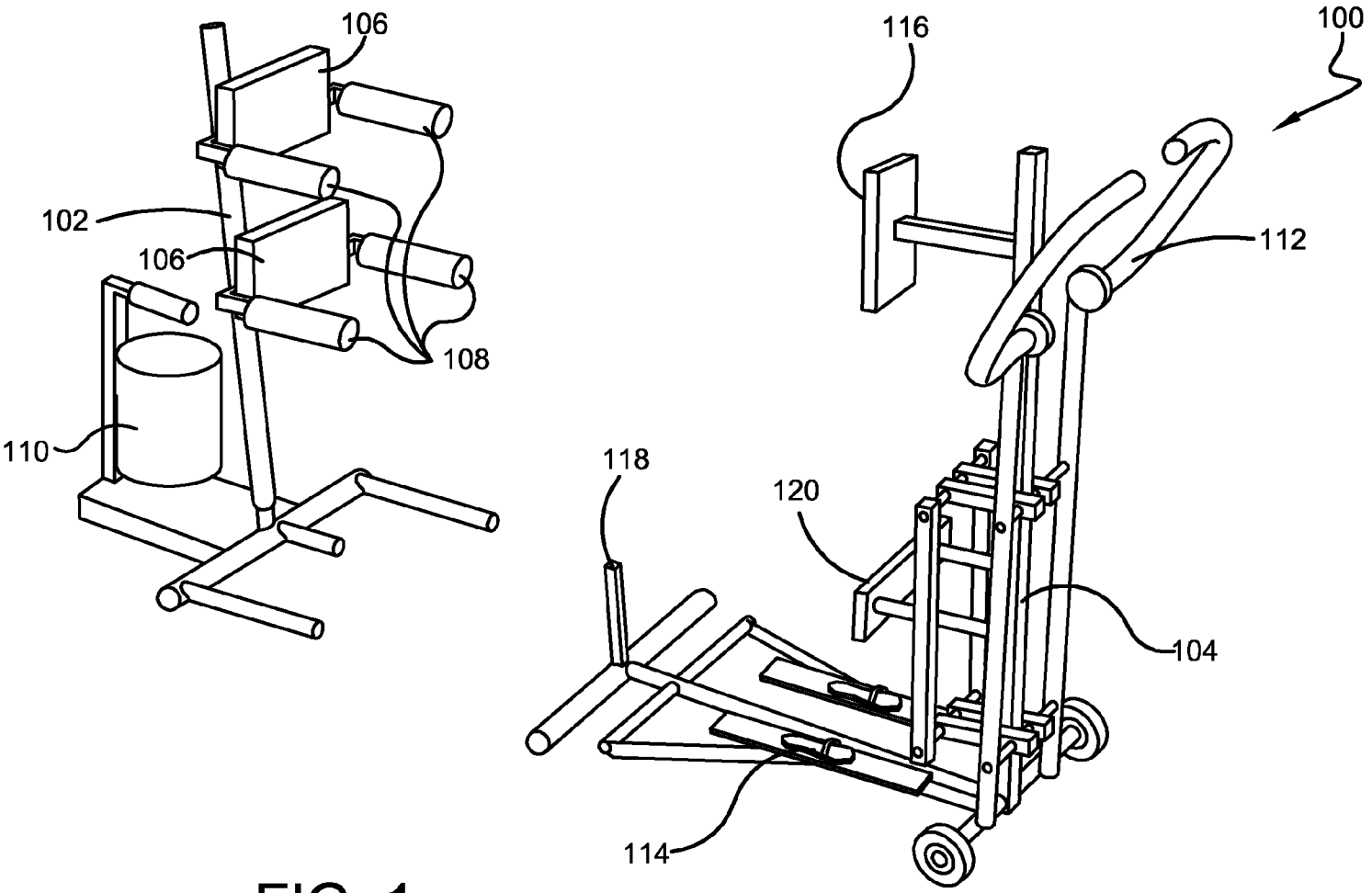
FIG. 1 illustrates a perspective view of an exercise device.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Teaching a paralyzed individual to walk again can be a daunting task. For example, it is difficult for others to support an individual in a way that allows the individual's muscles to function properly. An exercise device for rehabilitation would allow paralyzed individuals to stand and move their arms and legs in a walking pattern without the assistance of others.

Accordingly, the disclosed exercise device is designed for individuals that have lost their mobility from an accident, spinal injury, stroke, or other debilitating condition. The device allows a paralyzed individual to stand and move their arms and legs in a walking pattern without the assistance of others. This motion exercises the muscles to aid in rehabilitation and to prevent muscle atrophy.

Referring initially to the drawings, FIG. 1 illustrates an exercise device 100 for rehabilitation. The exercise device 100 comprises a first unit 102 and a second unit 104. The first unit 102 comprises at least one back rest 106 and at least two sets of braces 108. The back rests 106 help to position a user (not shown) against the first unit 102. One of the back rests is placed posterior, mid-line between a user's shoulder blades. The other back rest is placed posterior, right above the hips of a user. Additionally, one set of braces extends from the top back rest, out around the sides of a user. This set of braces is positioned underneath the arm pits of a user. The other set of braces extends from the bottom back rest, at the hips of a user and extends out around the sides of a user. This set of braces is positioned around the hips of a user. The two sets of braces 108 can be raised or lowered and adjusted inwardly to secured the sides of the user, depending on the size and needs of a user. Preferably, the exercise device 100 comprises two sets of braces 108 and two back rests 106, however any number of sets of braces and back rests can be used without departing from the scope of the invention.

Furthermore, an electric motor 110 is mounted behind the user to power the exercise device 100. Typically, the motor 110 is a reduction electric motor, but could be any suitable motor known in the art. The motor 110 is mounted to the first unit 102 via pins and nuts, but may also be mounted by any suitable connectors known in the art.

Additionally, the second unit 104 of the exercise device 100 comprises at least two handles 112 for securing the hands of the user during exercising. Typically, the user is fitted with gloves that secure to the handles 112. The gloves have hook and loop fasteners, such as Velcro® that attach to the handles 112 to the secure the user's hands. However, the user's hands could be secured to the handles 112 via any suitable connectors known in the art. Additionally, hand straps can be used to further secure the gloves to the handles 112. The second unit 104 also comprises at least two foot pedals 114 for securing the feet of the user during exercising. Typically, the user's feet are secured to the foot pedals 114 via straps, but could be secured via any suitable connector known in the art. The handles 112 and foot pedals 114 act together and pivot inversely when in use, such that when a handle is moved forward the coordinating foot pedal moves back, and when a handle is moved back the coordinating foot pedal moves forward.

Furthermore, the second unit 104 comprises a front rest 116 and a knee rest 120. The front rest 116 helps to position the user against the second unit 104. The knee rest 120 abuts against the knees of a user when in use. Straps (not shown) can be used to secure the knees of a user to the knee rests 120, but knee rests 120 can also operate without straps.

Additionally, the first 102 and second 104 units are then secured together to form a single assembly. Specifically, the first unit 102 slides into the square tube 118 of the second unit 104, which secures the units together, against a user and prevents the units from separating during use.

Figure 2:
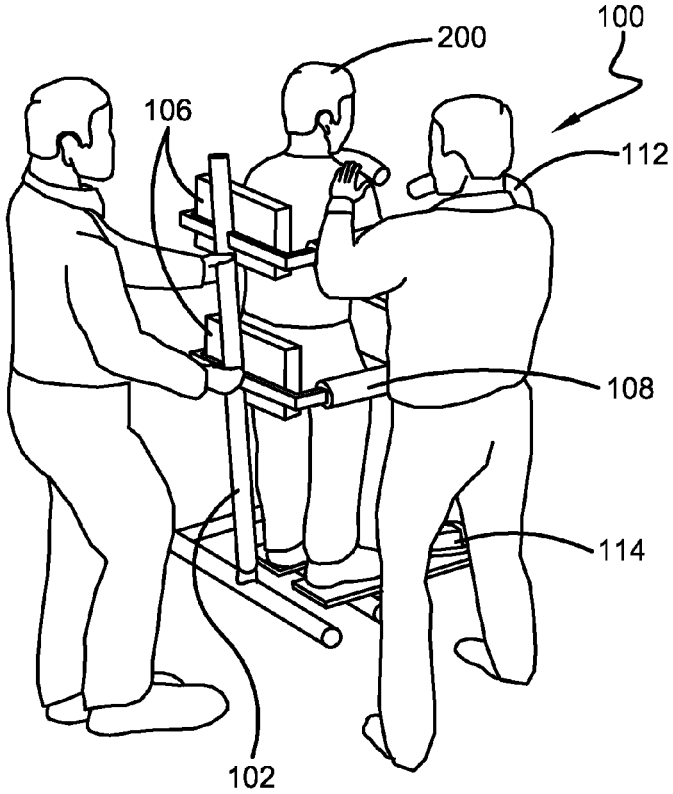
FIG. 2 illustrates a perspective view of a user being positioned in the exercise device.

FIG. 2 illustrates a user 200 being positioned in the exercise device 100. The first unit 102 of the exercise device 100 is positioned behind the user 200 and the user 200 is lifted to a standing position. The user 200 is then positioned against the back rest 106 of the first unit 102 and secured in position via the sets of braces (not shown).

Figure 3:
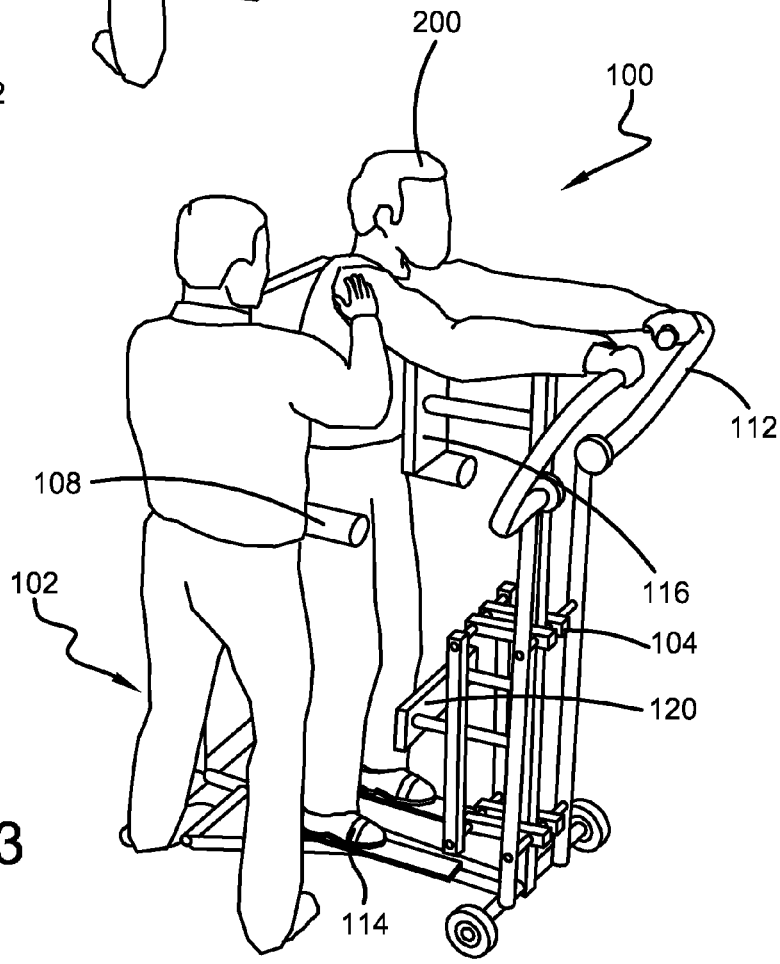
FIG. 3 illustrates a perspective view of the two units of the exercise device being secured to the user.

Furthermore, FIG. 3 illustrates the first 102 and second 104 units of the exercise device 100 being secured to the user 200. Once the user 200 is secured to the first unit 102, the second unit 104 is positioned in front of the user and the front rest is positioned against the user and secured. The first 102 and second 104 units are then secured together to form a single assembly. Specifically, the first unit 102 slides into the square tube of the second unit 104 (as shown in FIG. 1), which secures the units together and prevents the units from separating during use. The user's feet are then secured to the foot pedals 114 via straps or any other suitable connectors known in the art. And, the user's hands are secured to the handles 112 via gloves with hook and loop fasteners or any other suitable connectors known in the art.

Figure 4:
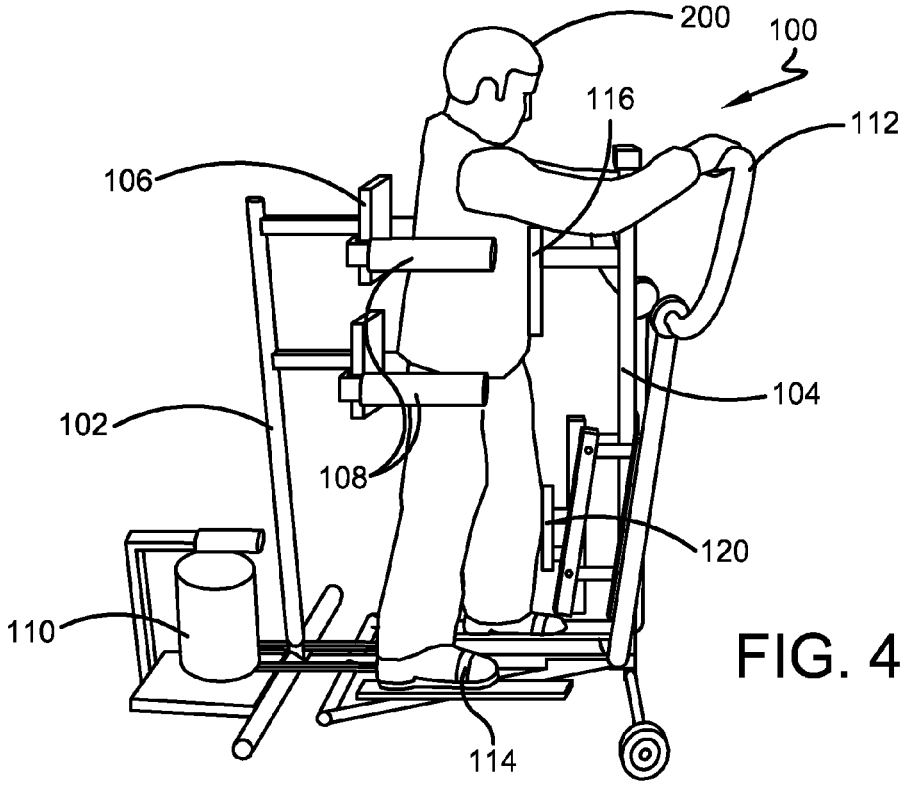
FIG. 4 illustrates a perspective view of the user utilizing the exercise device.

FIG. 4 illustrates the user 200 utilizing the exercise device 100. Once the user 200 is secured between the first unit 102 and second unit 104, the first 102 and second 104 units are then secured together to form a single assembly. The user's feet are then secured to the foot pedals 114 via straps and the user's hands are secured to the handles 112 via gloves with hook and loop fasteners. The brake nut of the electric motor 110 is released and the electric motor 110 is then powered on. Thus, the exercise device 100 allows a paralyzed individual to stand and move their arms and legs in a walking pattern without the assistance of others. The exercise device 100 also comprises varied adjustments for all sizes of users. For example, the sets of braces can be moved to different positions or additional braces can be added to the exercise device 100.

Figure 5:
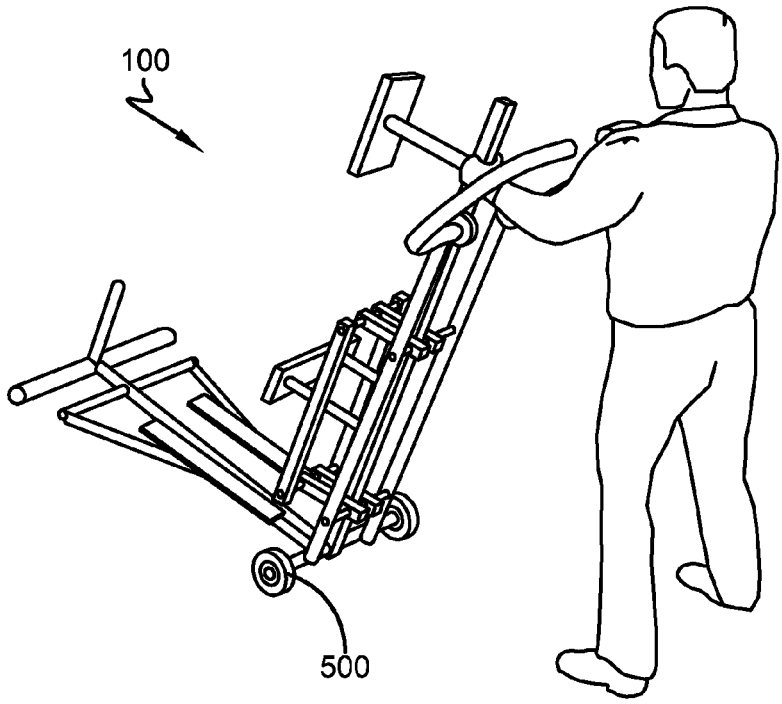
FIG. 5 illustrates a perspective view of the exercise device being easily moved.

FIG. 5 illustrates the exercise device 100 being easily moved. The exercise device 100 comprises wheels 500 that allow the device 100 to be easily transported. For example, the exercise device 100 can be moved by combing the first and second units and tipping the units onto the wheels 500 and rolling the units to a desired location.

Figure 6:
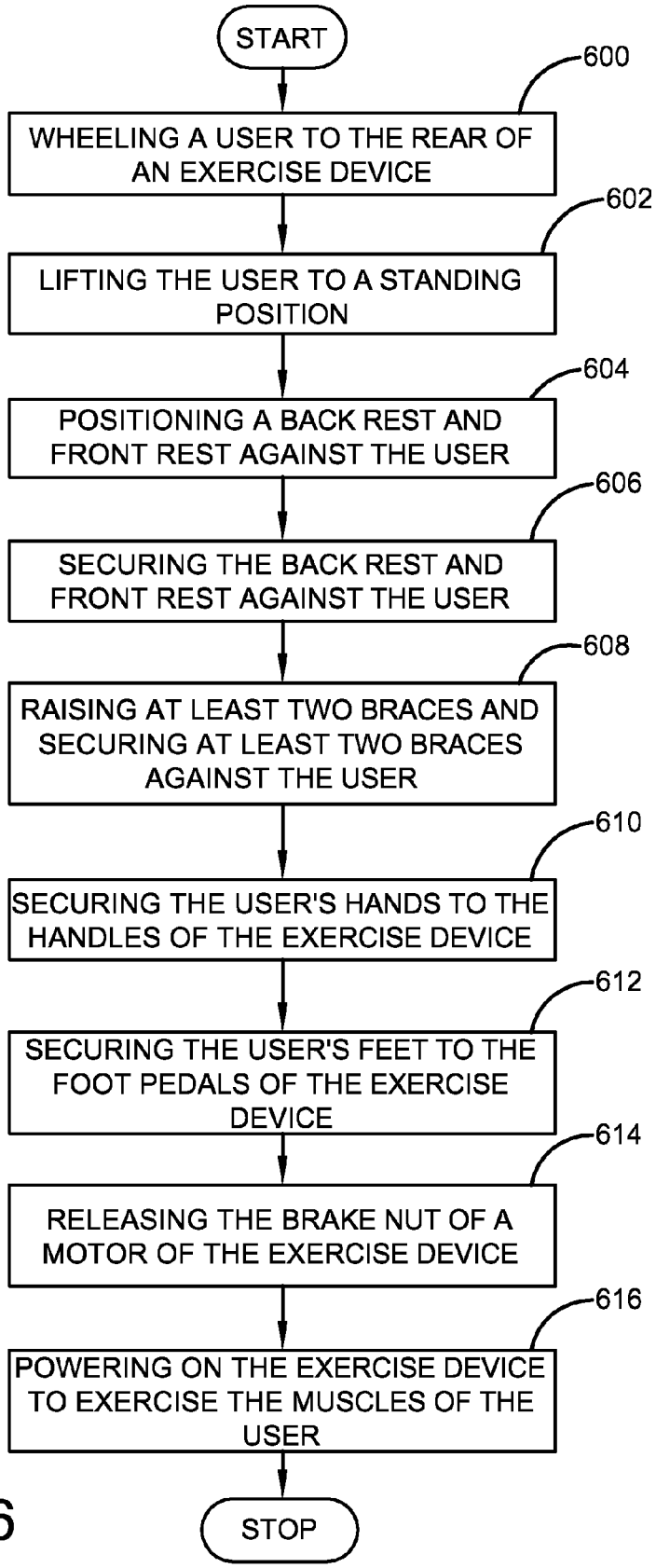
FIG. 6 illustrates a method of rehabilitating a user.

FIG. 6 illustrates a methodology of rehabilitating a user, according to various aspects of the innovation. While, for purposes of simplicity of explanation, the one or more methodologies shown herein (e.g., in the form of a flow chart or flow diagram) are shown and described as a series of acts, it is to be understood and appreciated that the subject innovation is not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

Referring to FIG. 6, a method of rehabilitating a user with an exercise device is illustrated. At 600, a user is wheeled to a rear of an exercise device. The user can be wheeled to the rear of the device in their wheelchair or hospital bed or any other suitable device. At 602, the user is lifted to a standing position. Multiple people may lift the user to a standing position to be secured to the exercise device. At 604, the user is positioned against the back rests and front rest of the exercise device. At 606, the back rests and front rest are secured in place against the user. An additional person may secure the back rests and front rest against the user, as the other individuals retain the user in a standing position. The back rests and front rest can be secured against the user via any suitable connectors as is known in the art. Specifically, a first unit of the exercise device is slid into a square tube of a second unit of the exercise device, which secures the units together, secures the back rests and front rest against a user and prevents the units from separating during use. At 608, at least two sets of braces are raised and secured to the user. Once the back rests and front rest are in place, the braces can be raised and secured on either side of the user. The braces can be adjusted and secured at different positions on the exercise device, or additional braces can be added to the exercise device depending on the size and needs of the user.

At 610, the user's hands are secured to the handles of the exercise device. Typically, the user is fitted with gloves that secure to the handles of the exercise device. The gloves have hook and loop fasteners that attach to the handles to the secure the user's hands. However, the user's hands could be secured to the handles via any suitable connectors known in the art. At 612, the user's feet are secured to the foot pedals of the exercise device. Typically, the user's feet are secured to the foot pedals of the exercise device via straps, but could be secured via any suitable connector known in the art. At 614, a brake nut of the electric motor of the exercise device is released. And at 616, the exercise device is powered on to exercise muscles of the user. The motor is typically a reduction electric motor but could be any suitable motor to power the exercise device as is known in the art.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An exercise device for rehabilitation comprising:

at least two handles for securing hands of a user;

a front rest and at least one back rest to position a body of the user;

at least two foot pedals for securing feet of the user; and an electric motor;

wherein the device comprises two units joined together to secure the user in a standing position between the two units;

wherein a first unit comprises at least one back rest, at least two sets of braces that are raised and secured on either side of the user and an electric motor; and wherein a second unit comprises a front rest, at least two handles and at least two foot pedals; and wherein the at least two handles and the at least two foot pedals act together and pivot inversely when in use, such that when one of the at least two handles is moved forward one of the at least two foot pedals moves back, and when one of the at least two handles is moved back one of the at least two foot pedals moves forward.

2. The exercise device of claim 1, further comprising wheels to allow the device to be moved.

3. The exercise device of claim 1, wherein straps are used to secure the user's feet on the at least two foot pedals.

4. The exercise device of claim 3, wherein a user is fitted with gloves that secure the user's hands to the at least two handles.

5. The exercise device of claim 4, wherein the gloves comprise hook and loop fasteners which attach to the at least two handles.

6. A method of rehabilitating a user, comprising:

wheeling a user to a rear of an exercise device;

lifting the user to a standing position;

positioning a back rest and front rest against the user;

securing the back rest and front rest in place against the user to secure the user in a standing position;

raising at least two sets of braces and securing the at least two sets of braces to the user;

securing the user's hands to handles of the exercise device;

securing the user's feet to foot pedals of the exercise device; and powering on the exercise device to exercise muscles of the user by moving a user's arms and legs in a walking pattern.

7. The method of claim 6, wherein straps are used to secure the user's feet on the foot pedals of the exercise device.

8. The method of claim 7, wherein gloves are used to secure the user's hands to the handles of the exercise device.

9. The method of claim 8, wherein the gloves comprise hook and loop fasteners which attach to the handles of the exercise device.

10. The method of claim 9, wherein the motor is a reduction electric motor.

11. An exercise assembly for rehabilitating a user comprising:

a first unit comprising at least one back rest, at least two sets of braces that are raised and secured on either side of the user and an electric motor; and a second unit comprising a front rest, at least two handles and at least two foot pedals;

wherein the first and second units are joined together to secure the user in a standing position between the first and second units; and wherein the at least two handles and the at least two foot pedals act together and pivot inversely when in use, such that when one of the at least two handles is moved forward one of the at least two foot pedals moves back, and when one of the at least two handles is moved back one of the at least two foot pedals moves forward.

12. The exercise assembly of claim 11, wherein straps are used to secure the user's feet on the at least two foot pedals.

13. The exercise assembly of claim 12, wherein a user is fitted with gloves that secure the user's hands to the at least two handles.

14. The exercise assembly of claim 13, wherein the gloves comprise hook and loop fasteners which attach to the at least two handles.

15. The exercise assembly of claim 14, further comprising wheels to allow the assembly to be moved.

* * * * *